United States Patent [19]

Vogel et al.

[11] 4,067,482

[45] Jan. 10, 1978

[54] DISPENSING AND ACTUATOR CAP FOR AEROSOL PACKAGES

[75] Inventors: Günter Vogel; Herbert Schwarz, both of Nurnberg, Germany

[73] Assignee: Aerosol Inventions and Development S.A. Aid SA, Switzerland

[21] Appl. No.: 682,669

[22] Filed: May 3, 1976

[30] Foreign Application Priority Data

May 7, 1975 Germany ..... 7514807[U]

[51] Int. Cl.[2] ..... B65D 83/14

[52] U.S. Cl. ..... 222/153; 222/402.11; 222/402.13

[58] Field of Search ..... 222/402.11, 402.13, 222/153

[56] References Cited

U.S. PATENT DOCUMENTS

| | | | |
|---|---|---|---|
| 3,185,349 | 5/1965 | Sagarin | 222/402.13 X |
| 3,539,078 | 11/1970 | Venus | 222/402.13 X |
| 3,610,479 | 10/1971 | Venus | 222/402.11 X |
| 3,642,179 | 2/1972 | Micallef | 222/402.11 X |
| 3,744,682 | 7/1973 | Blank | 222/402.11 |

FOREIGN PATENT DOCUMENTS

| | | | |
|---|---|---|---|
| 2,267,004 | 3/1975 | France | 222/402.13 |
| 2,252,494 | 10/1972 | Germany | 222/153 |

*Primary Examiner*—Robert B. Reeves
*Assistant Examiner*—Frederick R. Handren
*Attorney, Agent, or Firm*—Holman & Stern

[57] ABSTRACT

Dispensing cap for valves for aerosol containers, comprising a stationary body designed to be secured to the container and a dispensing push button which is designed to be connected to the actuating stem of the valve, wherein the body has a deformable portion which is hingedly or pivotally mounted on the remainder of the body at its two ends and which can be displaced inwards into the body for actuating the push button, and a frangible device which acts as a tamper-proofing device and which initially is connected first to the deformable portion of the body at at least two points lying on opposite sides of a hinge or pivotal connection of the deformable portion, and wherein the device, until the purchaser tears it off, prevents the deformable portion from being pressed inwards into the body.

7 Claims, 7 Drawing Figures

DISPENSING AND ACTUATOR CAP FOR AEROSOL PACKAGES

BACKGROUND OF THE INVENTION

The present invention relates to dispensing and actuator caps such as are employed for the manual operation of dispensing valves on aerosol containers.

In most of the known caps of this kind there is nothing to prevent the button from being actuated by mistake, in particular when the container is held in the hand, or to prevent the button from being actuated by persons other than the purchaser of the container, especially when such containers are on sale in self-service shops.

In other known caps an attempt has been made to overcome these above-mentioned drawbacks by providing them with 'tamper-proofing' devices which guarantee the purchaser that the container is full. These devices comprise, according to circumstances, a tear-off cover which only gives access to the button when the cover has been torn off, or they comprise detachable struts or webs which must be removed to allow the spraying button to be freed.

In both of the above-mentioned cases these tamper-proofing devices lead to a substantial increase in the difficulty of manufacture of the cap and in the assembly of its individual components; the manufacturing costs are thereby significantly increased.

SUMMARY OF THE INVENTION

The present invention lies in solving the problem of overcoming the drawbacks of the known actuator caps which are provided with a device for preventing any undesired actuation of the dispensing buttons.

The subject matter of the present invention is accordingly a dispensing cap for valves on aerosol containers with a fixed body for attachment to the container and a dispensing push button which is designed to be connected to the actuating stem of the valve; the cap is characterized in that the body comprises a deformable portion which is pivotally connected to the remainder of the body at both its ends and is displaceable inwards into the body for actuating the push button, and a tear-off device acting as a stiffening member and as a tamper-proofing device, which is initially connected to the above-mentioned deformable portion of the body at at least two points lying on opposite sides of a pivotal or hinged connection of the deformable portion and, until the purchaser tears it off, it prevents the deformable portion from being pressed inwards into the body.

The body of such a cap is capable of being manufactured as a unitary component, which naturally simplifies production.

According to one preferred embodiment of the present invention the deformable portion of the body comprises a strip cut out of the top wall and the side wall of the body and made up of three adjacent portions of which the first portion extends along the top wall of the body, while the second and third portions extend along the side wall of the body; the first and third portions are hingedly connected on the one hand to the body itself and on the other hand to the second portion.

According to another embodiment of the present invention the tear-off device connects the second and third portions on both sides of their hinged connection.

For a better understanding of the present invention three non-limiting embodiments will be described in conjunction with the accompanying drawings.

DETAILED DESCRIPTION OF PREFERRED EMBODIMENTS

The dispensing cap shown in FIGS. 1 to 5 is designed to be mounted on an aerosal container 1.

Figure 2:
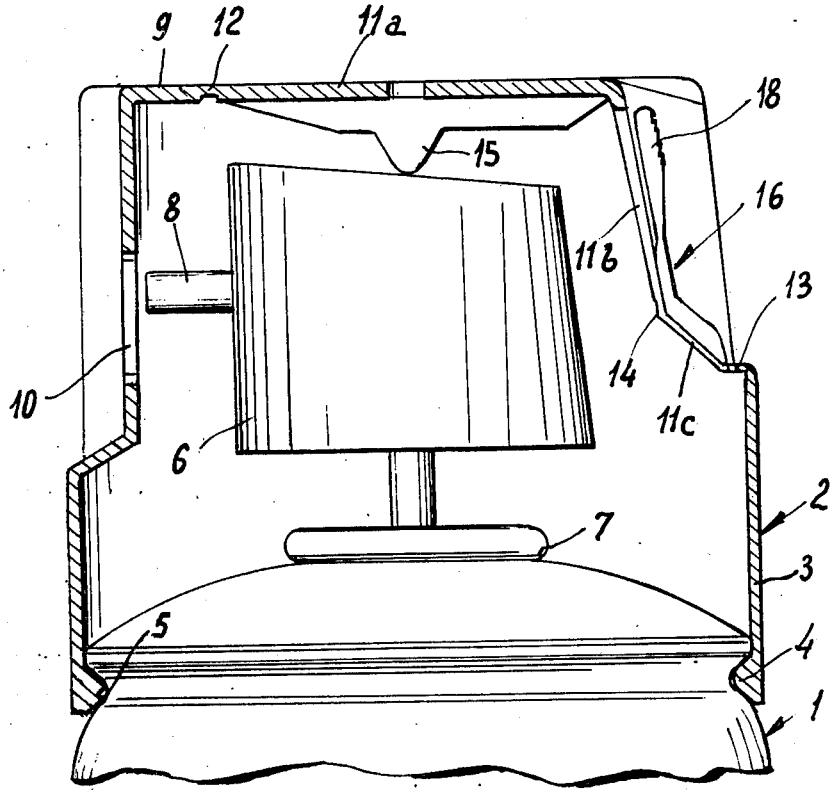
FIG. 2 is an axial section through the cap of FIG. 1 shown fitted in position and in its rest condition.

The cap comprises substantially:

- a fixed body 2 with a peripheral wall portion 3 at the lower end of which there is formed a bead 4 which engages in a groove 5 on the container 1 and holds the body 2 onto the container 1;
- a dispensing push button 6 which cooperates with the container valve, of which in FIG. 2 one only sees the rim 7, and which carries a spraying nozzle 8.

The fixed body 2 has a top wall 9 rigidly connected to its side wall 3. In line with the spraying nozzle 8 the side wall 3 has an opening 10.

Figure 1:
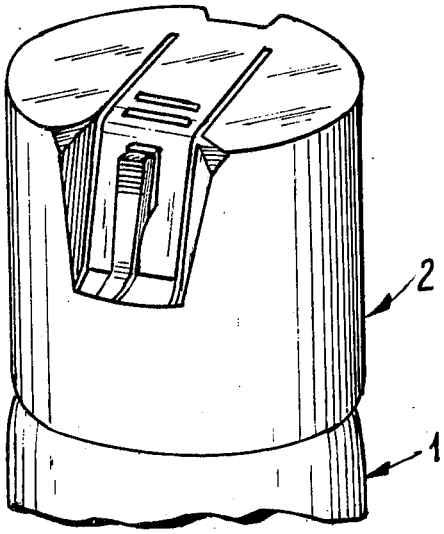
FIG. 1 shows a first embodiment of the cap mounted on an aerosol container.
Figure 3:
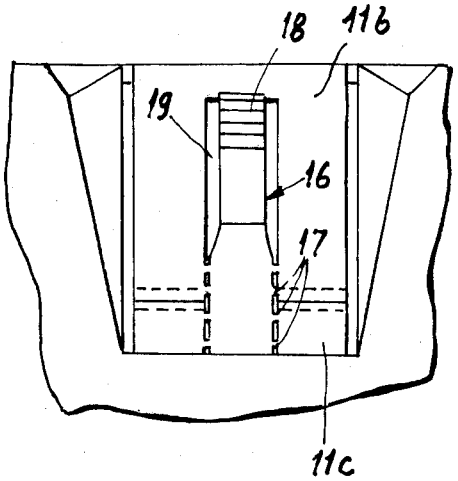
FIG. 3 is a partial elevation looking from the right in FIG. 2.

Part of the top wall 9 and the side wall 3 is cut away so as to define a strip 11 made up of three portions 11*a*, 11*b*, and 11*c*; on the first portion 11*a* there is a projection 15 for actuating the push button 6 and this portion is pivotally connected at 12 by its one end to the remainder of the top wall 9; the third portion 11*c* is connected at 13 to the remainder of the wall 3. Finally the second portion 11*b* and the third portion 11*c* are connected together through a flexible hinged pivotal connection 14. As will be seen in FIG. 4, the first portion 11*a* of the strip 11 is stationary and rigid while the second portion 11*b* and the third portion 11*c* are relatively flexible. As shown in FIGS. 1 and 3, the second portion 11*b* and the third portion 11*c* are connected through frangible webs 17 to a bar 16. One end of the bar 16 is free and forms a tab 18 for tearing off the bar, this end lying in front of a window 19 cut in the strip 11.

The purpose of the bar 16 is readily apparent from FIGS. 1 to 5.

As long as the bar 16 remains rigidly secured to the strip 11, it prevents flexing of this strip 11. Accordingly the push button 6 cannot be actuated. Moreover the presence of the bar forms a guarantee that the container fitted with such a cap has not yet been used.

Before using the container 1 the purchaser tears off the bar 16 by pulling on the tab 18.

Figure 5:
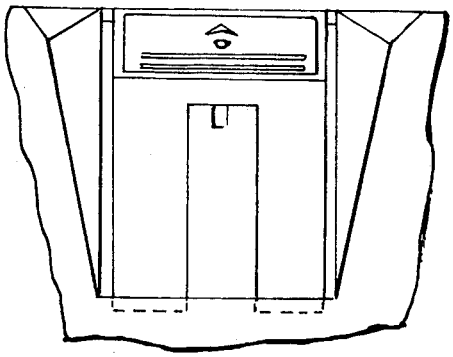
FIG. 5 is a partial elevation looking from the right in FIG. 4.
Figure 4:
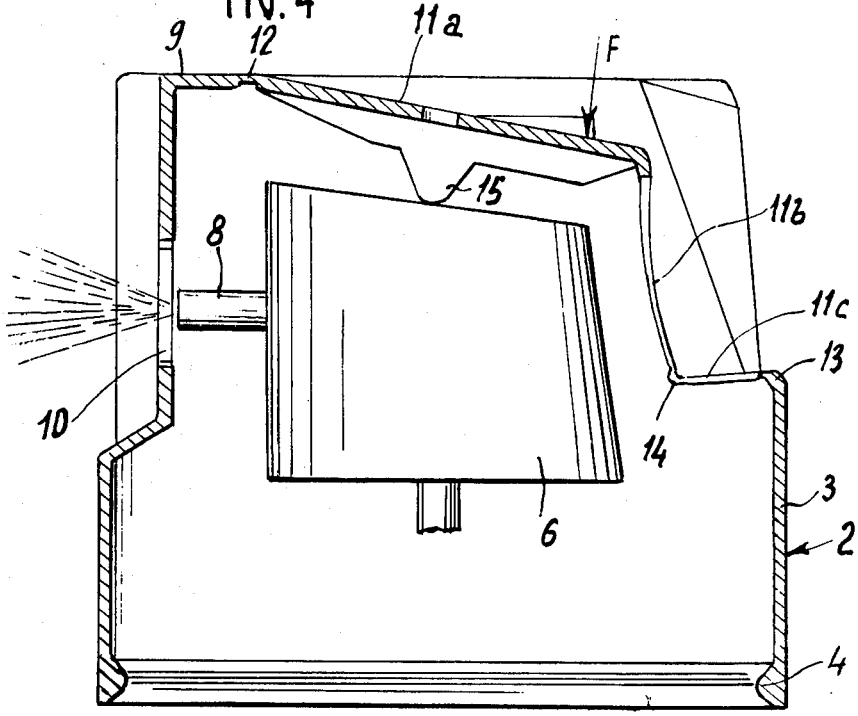
FIG. 4 is an axial section through the cap of FIG. 1 in the dispensing position.

Then, as shown in FIGS. 4 and 5, hand pressure can be applied to the first portion 11*a* of the strip 11 in the direction of the arrow F. The portions of the strip 11 now take up the positions shown in FIG. 4 in which the projection 15 exerts pressure on the push button 6 and thereby on the valve in the container 1; in this way the contents of the container are dispensed. As soon as the user no longer exerts pressure in the direction of the arrow F, the return spring of the valve displaces the button 6 and thereby returns the portions of the strip 11 to their starting positions.

Figure 6:
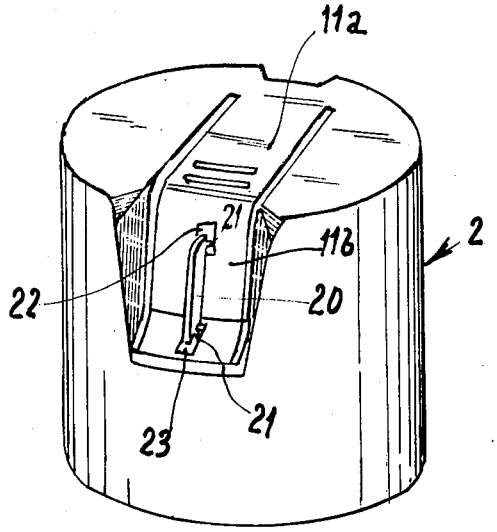
FIG. 6 is a perspective view of a second embodiment of the cap.

The second embodiment, shown in FIG. 6, differs from that of FIGS. 1 to 5 only in the form of the tear-off device for initial stiffening of the strip 11 which here has the form of a reinforcing web 20.

The reinforcing web 20 has a rectangular cross section with its major axis in the plane of symmetry of the strip. At its two ends the web 20 is connected to the second and third portions **11*b* and 11*c* of the strip 11 by frangible webs 21 which extend across windows 22 and 23**, each of which is provided in one of the stated portions.

Figure 7:
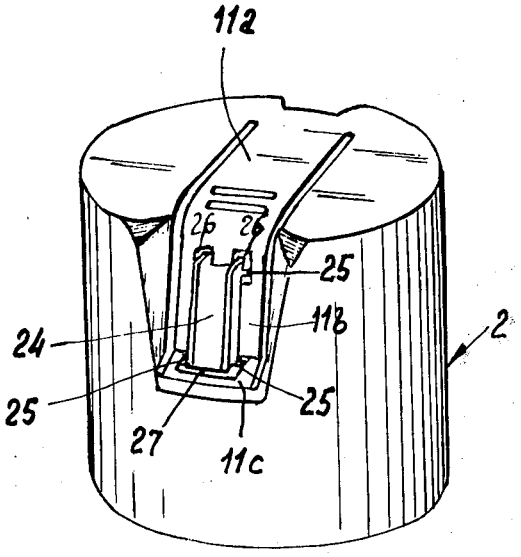
FIG. 7 is a perspective view of a third embodiment of the cap.

The third embodiment of the present invention, illustrated in FIG. 7, differs from that of FIG. 6 only in the shape of the reinforcing web 24 which has a U-shaped cross section, the U being open towards the strip 11. Tear-off or frangible webs 25 extend across windows 26 and 27.

The reinforcing webs 20 (FIG. 6) and 24 (FIG. 7) have the same purpose as the bar 16, the significance of which has been explained above.

The permanent attachment of the fixed body 2 to the container 1 can be obtained not only by the bead 4 engaging the body of the container but by any other known means, for example by having a toothed engagement on the valve mounting cap which is incorporated in the container.

What is claimed is:

1. A dispensing cap for valves for aerosol containers comprising a stationary body with means for securing it to a container, a dispensing push button connectable to an actuating stem of a valve mounted on said container, an inwardly deformable strip for actuating said push button, said deformable strip comprising at least two resiliently deformable portions extending inwardly from a top wall and a side wall of said body respectively and hingedly connected together at their inward ends, and a rigid tear-off device for preventing inward deformation of said portions until first use of said cap, said tear-off device extending at least partly through windows provided through said two portions, said tear-off device being connected to said portions by frangible webs, and extending at least partly outwardly from said portions to form a manually engageable tab for tearing off said rigid device.

2. The dispensing cap according to claim 1, wherein said strip comprises a rigid top portion hingedly connected to said stationary body and extending along the top wall of said body and wherein said two deformable portions are respectively hingedly connected to said top portion and to said side wall of said body.

3. The dispensing cap according to claim 1, wherein said tear-off device comprises a rigid bar extending along a longitudinal axis of said strip, said frangible webs are provided on either sides of said bar to connect said bar to both said two portions on opposite sides of their hinge connection, and said bar having a free upwardly outwardly extending end forming said tab.

4. The dispensing cap according to claim 1, wherein said tear-off device comprises a reinforcing web having two opposite ends respectively connected to said two portions by said frangible webs and a center part forming said tab.

5. The dispensing cap according to claim 2 wherein the underside of the top portion of said strip has a projection which can engage the spraying push button.

6. The dispensing cap according to claim 4 wherein the reinforcing web has a rectangular cross section of which the major axis lies in the plane of symmetry of the strip.

7. The dispensing cap according to claim 4 wherein the reinforcing web has a U cross section with its concave side facing the said strip.

* * * * *